US005643417A

United States Patent [19]

Hanaya

[11] Patent Number: 5,643,417

[45] Date of Patent: Jul. 1, 1997

[54] METHOD AND APPARATUS FOR SHEET FORMATION

[75] Inventor: Morimasa Hanaya, Mishima, Japan

[73] Assignee: Tokushu Paper Mfg. Co., Ltd., Shizuoka-ken, Japan

[21] Appl. No.: 382,803

[22] Filed: Feb. 2, 1995

[30] Foreign Application Priority Data

Feb. 2, 1994 [JP] Japan ..... 6-030963

[51] Int. Cl.[6] ..... D21F 1/24

[52] U.S. Cl. ..... 162/300; 162/303; 162/304; 162/348; 162/350; 162/354

[58] Field of Search ..... 162/301, 300, 162/304, 348, 350, 354, 272, 273, 274, 289, 298, 303

[56] References Cited

U.S. PATENT DOCUMENTS

| | | | |
|---|---|---|---|
| 3,997,390 | 12/1976 | Kankaanpaa | 162/273 |
| 4,523,978 | 6/1985 | Pullinen | 162/301 |
| 4,532,008 | 7/1985 | Creagan et al. . | |
| 4,544,447 | 10/1985 | Pinter et al. | 162/301 |
| 4,623,429 | 11/1986 | Tissari | 162/354 |
| 4,686,004 | 8/1987 | Fujiwara | 162/301 |
| 5,248,392 | 9/1993 | Bando et al. | 162/301 |
| 5,437,769 | 8/1995 | Bando et al. | 162/301 |

FOREIGN PATENT DOCUMENTS

| | | |
|---|---|---|
| 0 153 288 | 8/1985 | European Pat. Off. . |
| 0 552 139 | 7/1993 | European Pat. Off. . |
| 31 00 713 | 7/1982 | Germany . |
| 2 106 945 | 4/1983 | United Kingdom . |

*Primary Examiner*—Peter Chin

*Attorney, Agent, or Firm*—Oblon, Spivak, McClelland, Maier & Neustadt, P.C.

[57] ABSTRACT

In a method for forming a sheet from a fiber-water suspension, the fiber-water suspension is supplied on a traveling bottom wire at a first zone thereof to dewater the fiber-water suspension. Subsequently, the suspension is introduced between the bottom wire at a second zone and a top wire, and dewatering is effected. The sheet is further caused to travel around a sheet-forming roll while keeping the sheet in contact therewith by the bottom wire at a third zone thereof, and reformation of the sheet is carried out. Finally, the sheet on the bottom wire is caused to travel up to a fourth zone thereof to effect a further dewatering with a fourth dewatering device disposed adjacent to the bottom wire at the fourth zone thereof, whereby a final stage of sheet formation is carried out. An apparatus for carrying out the above method is also disclosed.

4 Claims, 6 Drawing Sheets

METHOD AND APPARATUS FOR SHEET FORMATION

BACKGROUND OF THE INVENTION

1. Field of the Invention

The present invention pertains to a method and apparatus for forming a sheet of paper, wet-type nonwoven fabric or the like, and more particularly to a novel sheet forming method and apparatus which permits easy modification of the endlesswire arrangements on the basis of sheet-making conditions, including the kinds of raw fibrous materials, freeness or consistency thereof, filler conditions, basis weights, and machine speeds, to achieve excellent fiber orientation, yield and physical properties of the sheet for any kind of sheet products.

2. Related Art

The conventional sheet forming techniques in the manufacture of mass-production paper have been specialized corresponding to kinds of paper; i.e., newsprint paper (produced of a pulp mixture of TMP, BCTMP, SGW, RGP, CGP, GP, NBKP, newsprint waste paper and the like); kraft paper (produced essentially of NUKP); wood-free printing paper and coating base paper (produced essentially of LBKP); liner board (produced essentially of high-yield NUKP and waste corrugated board); corrugating medium (produced essentially of SCP and waste corrugated board); and domestic tissue paper (produced essentially of LBKP and newsprint or magazine waste paper).

Furthermore, long-fiber material such as paper mulberry, Mitsumata (Edgeworthia papyrifera), hemp or rayon is used to manufacture Japanese traditional paper. Powder of calcium carbonate, aluminum hydroxide or the like is the essential material for the production of nonflaming paper, whereas synthetic fibers such as aramid fiber (Du Pont's trade name), polyester fiber or nylon fiber, chemical fibers such as rayon fiber, inorganic fibers such as fibers of glass, slag or cement, and fibers of metal such as stainless steel are used to manufacture speciality papers and nonwoven fabrics for various uses. For the production of these kinds of speciality papers and nonwoven fabrics, various special types of paper machines such as a short-wire former, a cylinder mold or an inclined-wire former have been utilized.

Modifications to or improvements on the aforesaid specialized paper-making machines have been naturally required due to the change with the times, to technology development and innovation, to variations in market economy, and to changes in raw materials, basis weights or physical properties of the products.

In some cases for specific paper products, the operations of paper-making machines have been forced to be suspended for a long period due to inventory adjustment. However, even though reconstruction of the paper-making machine, the operation of which has been suspended for a long time, is planned to be able to manufacture different paper products, a vast expense is required due to space problems, sectional drive assemblies and transformer station requirements, and because additional pile driving work is required for the machine foundation in the building, which is usually two-storied.

Conventional paper-making machines for the manufacture of mass-production papers include a gap former for newsprint paper; a multi short-wire former or a multi on-top former for liner board; a hybrid former for wood-free printing paper; and a gap or suction former for tissue paper. However, each of these paper machines is specialized and cannot be operated under conditions other than those for which it was specifically designed; therefore their operations are limited due to the kinds of raw fibrous material used, consistency or freeness of the stock, basis weights, paper-making speeds, and product grades, resulting in a loss of flexibility in an industry which intrinsically requires vast investment.

Furthermore, conventional paper-making machines designed for the production of speciality papers include an inclined-wire former with a pond slice, a suction former, a multi-vat former, a short-wire former, and a shake-type Fourdrinier machine. Each of these paper machines is also specialized and cannot be operated under conditions other than those for which it was specifically designed; therefore their operations are limited due to the kinds of raw fibrous material, consistency or freeness of the stock, basis weights, paper-making speeds, and product grades, resulting in a loss of flexibility in the pulp and paper industry.

Additionally, the pulp and paper industry runs the gamut of gigantic firms with annual sales of one trillion yen to small mills with one hundred million yen in annual sales. Specialization of the paper-making machines, while contributing to the sales of machine suppliers, results in most of the firms in the pulp and paper industry making vast investments which do not even reach an annual turnover ratio of sales of ½. Thus, management is subjected to price pressure, resulting in loss of flexibility.

SUMMARY OF THE INVENTION

It is therefore the object of the present invention to provide a method and apparatus for forming a sheet, which permits easy modification of the endless wire arrangements to meet any change in the sheet-making conditions, including the kinds of raw fibrous materials used, freenesses, temperature or consistency of the stock pulp, filler or additive conditions, basis weights, kinds of paper to be produced, and machine speeds.

According to a principal aspect of the invention, there is provided a method for forming a sheet from a fiber-water suspension, comprising the steps of:

(a) supplying the fiber-water suspension on a traveling bottom wire at a first zone thereof to dewater the fiber-water suspension with a first dewatering device disposed adjacent to the bottom wire at the first zone, whereby a first stage of sheet formation is carried out;

(b) subsequently traveling the sheet on the bottom wire at a second zone thereof, and dewatering the sheet with a second dewatering device disposed adjacent to the bottom wire at the second zone thereof, whereby a second stage of sheet formation is carried out;

(c) subsequently traveling the sheet around a sheetforming roll while keeping the sheet in contact therewith by the bottom wire at a third zone thereof, and carrying out reformation of the sheet; and (d) subsequently traveling the sheet on the bottom wire at a fourth zone thereof to effect a further dewatering with a fourth dewatering device disposed adjacent to the bottom wire at the fourth zone thereof, whereby a final stage of sheet formation is carried out.

With this multi-stage sheet formation method, it becomes possible to modify the endless wire arrangements very easily to meet any change in sheet-making conditions, including the kinds of raw fibrous materials used, freenesses, temperature or consistency of the stock pulp, filler or additive conditions, basis weights, kinds of paper to be produced, and machine speeds. More specifically, in the method of the invention, the dewatering is gradually carried out in multi-stages, and the sheet formed at the initial stages is subjected to reformation by the operation of the sheet-forming roll. In the first stage of sheet formation, the fiber-water suspension is preferably held on the upwardly-inclined bottom wire to ensure sufficient dispersion of fiber thereon by applying various vibrations in vertical and horizontal directions, and a small degree of dewatering is carried out. In the second stage of sheet formation, a top wire is preferably used to sandwich the initially-formed sheet between the top and bottom wires, and the top and bottom wires are caused to be inclined downwards to ensure optimal and effective control of the dewatering amount for both (up and down) directions. In the third stage, the sheet formed at the first and second stages is subjected to reformation by the operation of the sheet-forming roll, which permits the vertical flow of water to reform the sheet as well as the formation of various watermark. Finally, in the fourth stage, the dewatering is carried out on the horizontal or downwardly-inclined bottom wire to complete the formation of the sheet.

Thus, it is preferable that in the steps (b) and (c), a top wire is caused to travel along the bottom wire to interpose the sheet between the bottom wire and the top wire. It is also preferable that the first stage of sheet formation be carried out while keeping the bottom wire so as to be inclined upwards in a direction traveled by the fiber-water suspension, whereas the second stage of sheet formation be carried out while keeping the bottom wire so as to be inclined downwards in a direction traveled by the suspension. With these procedures, it is possible to ensure sufficient dispersion of fiber on the wire, an optimal initial formation of sheet, and adjustment of the difference between front and rear surfaces of the sheet. In the preferred arrangements, the bottom wire at the first stage should be inclined upwards in a direction traveled by the sheet at an angle of from −10° to 35°, whereas the bottom wire at the second stage be inclined downwards at an angle of from +10° to −40°.

Furthermore, in the present invention, it is preferable that the step (c) includes carrying out the reformation of the sheet by a peripheral dewatering device disposed adjacent to the sheet-forming roll, and that in the step (d), the final stage of sheet formation be carried out while keeping the bottom wire so as to be inclined downwards in the direction traveled by the sheet. In this regard, it is preferred that the bottom wire is wound around the sheet-forming roll over the circumference thereof at a wire-wound angle of from 170° to 0°. In addition, it is preferable that the step (c) includes causing the bottom wire, on which the fiber suspension is supplied, to travel around the sheet-forming roll to sandwich the sheet between the bottom wire and the sheet-forming roll while maintaining a circumferential zone of a predetermined length, at which the wire is wound around the sheet-forming roll, and pouring water on and/or sucking water from the sheet to effect reformation thereof.

According to another aspect of the invention, there is provided an apparatus for forming a sheet from a fiber-water suspension, comprising:

an endless bottom wire constructed to travel while receiving the fiber-water suspension thereon, the bottom wire defining first to fourth zones corresponding to first to fourth sheet-forming stages;

a first tilting device associated with the first zone of the bottom wire for adjusting inclination of the bottom wire at the first zone thereof;

a second tilting device associated with the second zone of the bottom wire for adjusting inclination of the bottom wire at the second zone thereof;

a sheet-forming roll associated with the third zone of the bottom wire for carrying out reformation of the sheet, the sheet-forming roll having a wound portion around which the bottom wire is wound to carry the sheet therebetween;

a drive device attached to the sheet-forming roll for shifting the sheet-forming roll;

a third tilting device associated with the sheet-forming roll for cooperating with the drive device to shift the sheet-forming roll relative to the bottom wire in a vertical plane to control a circumferential length of the wound portion;

a fourth tilting device associated with the fourth zone of the bottom wire for adjusting inclination of the bottom wire at the fourth zone thereof;

a plurality of dewatering devices each associated with a respective zone of the bottom wire; and a control unit operably connected to the first, second, third and fourth tilting devices and the drive device for adjusting the inclination of wire and the circumferential length of the wound portion.

With an apparatus of this construction, the sheet-forming method of the invention can be suitably carried out.

In the foregoing, a wire turning roll may be disposed adjacent to the sheet-forming roll for guiding the bottom wire so as to travel around the sheet-forming roll, and the dewatering device associated with the fourth zone of the bottom wire may be constructed to include at least one dewatering box arranged opposite to the fourth zone of said bottom wire. Furthermore, each of the tilting devices may be constructed to include a tilting frame for supporting the bottom wire and a drive device operably connected to the tilting frame for tilting the tilting frame. In addition, the apparatus may further include an endless top wire constructed to travel along the bottom wire at the second and third zones corresponding to the second and third sheet-forming stages.

DESCRIPTION OF THE PREFERRED EMBODIMENTS OF THE INVENTION

A method and apparatus for forming a sheet in accordance with the present invention will be hereinafter explained in detail with reference to the accompanying drawings.

Figure 1:
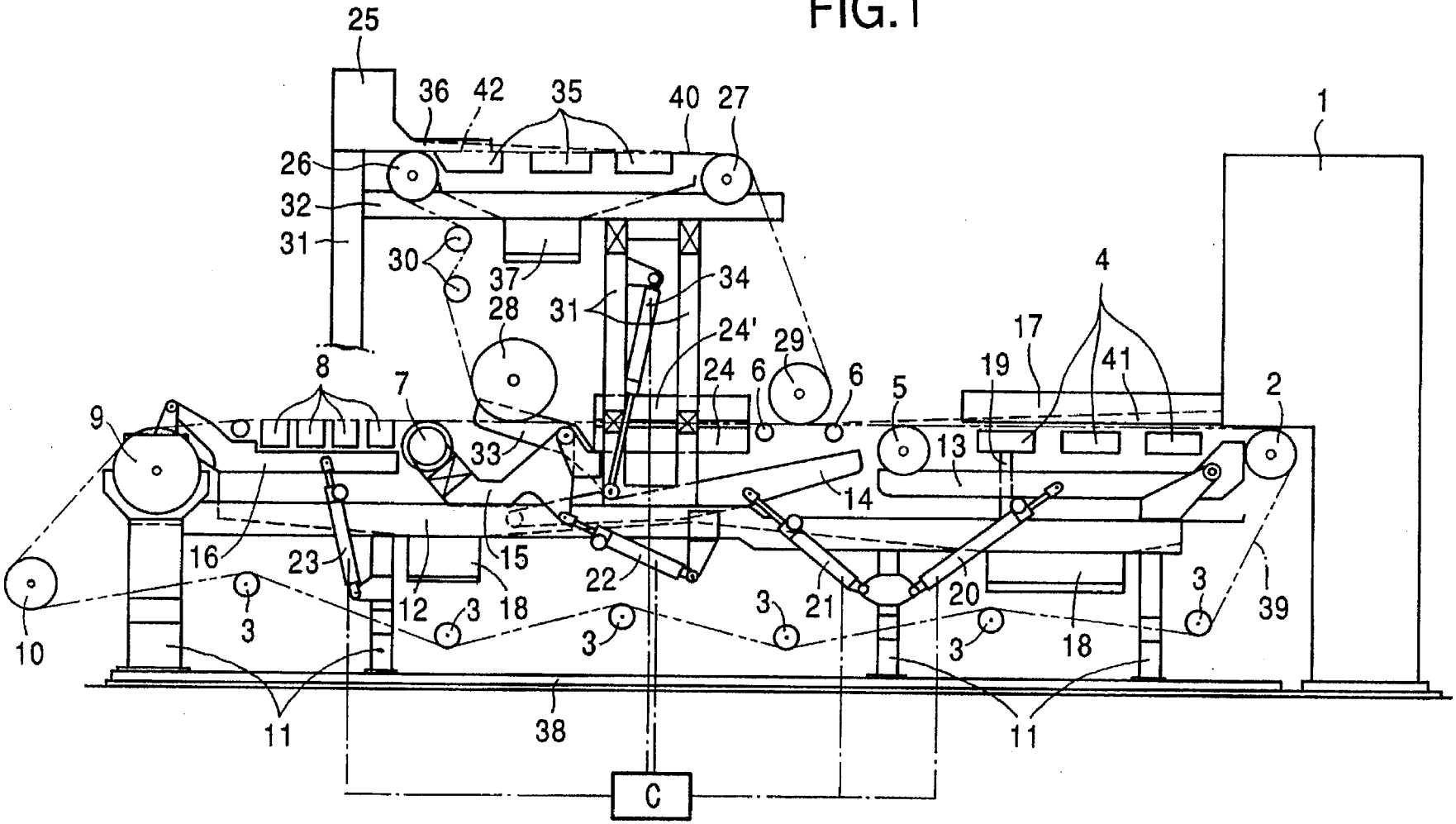
FIG. 1 is a side elevational view of an apparatus for forming a sheet in accordance with the present invention.

FIG. 1 depicts an apparatus for forming a sheet in accordance with the present invention, which is specifically adapted to carry out the sheet forming method of the invention, although apparatuses of other constructions could be used as well.

The apparatus comprises a head box 1 defining a passageway for supplying and distributing a stock (fiber-water suspension) onto a wire over its entire width in a uniform consistency. As shown in the drawings, in order to make it possible to form a sheet on an on-top wire 40, an on-top head box 25 having the same function as the head box 1 is also provided. Each head box 1, 25 is provided with nodeckles 17, 36 connected to right and left ends of a nozzle thereof, and is securely mounted on sole plates 38.

A machine frame assembly, comprised of a plurality of columnar frames 11 and a plurality of horizontal frames 12 connecting the columnar frames 11, is rigidly anchored on the sole plates 38 so as to generally cover the entire length of the apparatus ranging from the first to fourth stages of the sheet formation. A plurality of wire rolls 3, which support an endless bottom wire 39 while permitting its travelling, are mounted on the lower part of the machine frame assembly, and a breast roll 2 is mounted at a forward end of the machine frame assembly so as to be shiftable in horizontal and vertical directions, whereby the position of the stock, jetted in a thin layer form from the head box 1, can be adjusted in an optimum point.

Furthermore, a suction couch roll 9 enabling helper drive is mounted on a rearward end of the machine frame assembly. A wire driving roll 10, which is connected to a drive device (not shown) through flexible joints, is mounted at a position displaced somewhat rearwards from the couch roll 9 so as to be shiftable in forward and rearward directions according to the desired wire length.

For the first stage of the sheet formation, a first tilting frame 13 is mounted on the forward part of the machine frame assembly so as to tilt up and down about a forward end (right-hand end in FIG. 1) positioned adjacent to the breast roll 2. A first wire-turning roll 5, which is operable to receive and guide the bottom wire 39 and defines a first point of inflection for the sheet formation arrangement, is mounted on a rearward tip end of the tilting frame 13, and a drive device 20, comprised of servo motors, is mounted on the machine frame assembly with screw axis connected to the tilting frame 13 to permit tilting movement of the tilting frame 13. Thus, the bottom wire 39 can be inclined upwards or downwards about the fulcrum adjacent to the breast roll 2. In the preferred embodiment, the tilting frame 13 is designed so as to be tilted upwards in a rearward direction at an inclination angle of −10°~0°~+35°. Furthermore, a number of formation boards and/or multi-foils 4 are releasably mounted on the tilting frame 13 so as to be held in contact with the lower side of the bottom wire 39 travelling at the first zone or stage between the breast roll 2 and the first wire-turning roll 5.

For the second stage of the sheet formation, a second tilting frame 14 is mounted on the middle part of the machine frame assembly so as to tilt up and down about a rearward end (left-hand end in FIG. 1) thereof, and a drive device 21 comprised of servo motors is mounted on the machine frame assembly with screw axis connected to the second tilting frame 14 to permit tilting movement of the tilting frame 14. In the preferred embodiment, the second tilting frame 14 is designed so as to be tilted downwards in a rearward direction at an inclination angle of +10°~0°~−40°. Furthermore, a plurality of table rolls 6 are mounted on the forward end of the second tilting frame 14 so as to be held in contact with the lower side of the bottom wire 39, whereas variable pressure foils 24 are mounted on the rearward portion of the second tilting frame 14 so as to be held in contact with the lower side of the bottom wire 39 travelling through the second zone or stage.

Moreover, a sheet-forming roll 28 enabling helper drive, which roll is operable to receive and guide the bottom wire 39 and carry out reformation of the sheet, is mounted on a frame 33 disposed adjacent to the rearward end of the second tilting frame 14, the frame 33 being constructed to be pivotable by means of a drive device (servo motors) 34 to move the forming roll 28 up and down. Thus, the bottom wire 39 travelling above the second tilting frame 14 is caused to travel around the sheet-forming roll 28. In addition, a third tilting frame 15 is mounted on the horizontal frames 12 at a position adjacent to the rearward side of the sheet-forming roll 28 so as to tilt up and down about a forward end thereof, and a drive device 22 comprised of servo motors is mounted on the horizontal frames 12 with screw axis connected to the third tilting frame 15 to permit pivotal movement of the tilting frame 15. Furthermore, a second wire-turning roll 7, which is operable to receive and guide the wire and defines a point of inflection for the sheet reformation by means of the sheet forming roll 28, is mounted on the rearward end of the third tilting frame 15.

Figure 6:
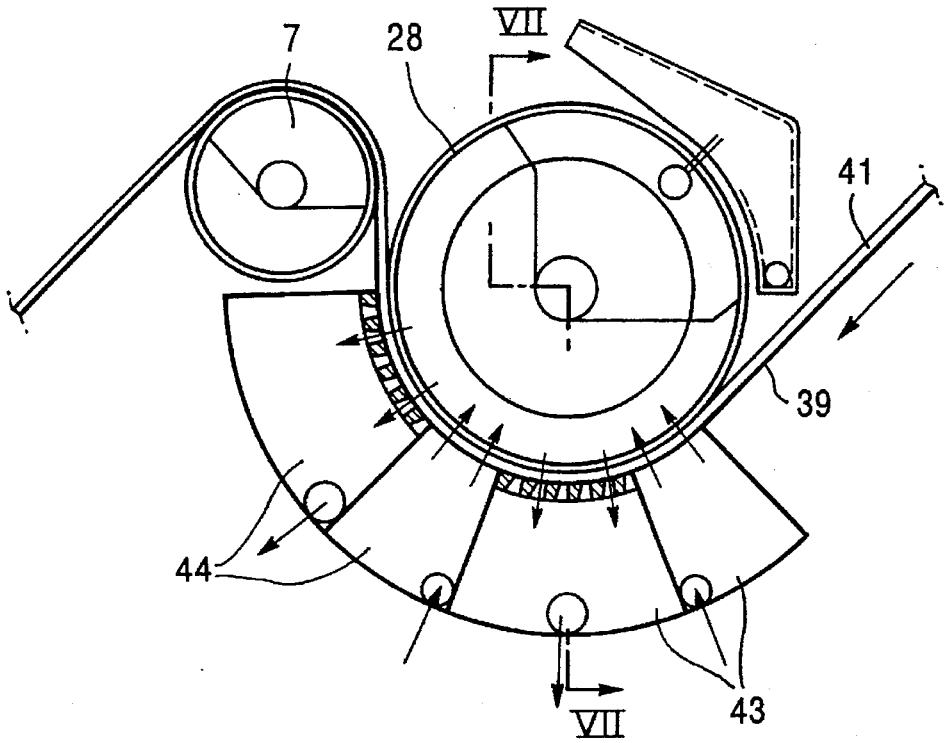
FIG. 6 is a cross-sectional view of a sheet-forming roll used in the apparatus of FIGS. 1 to 5.
Figure 7:
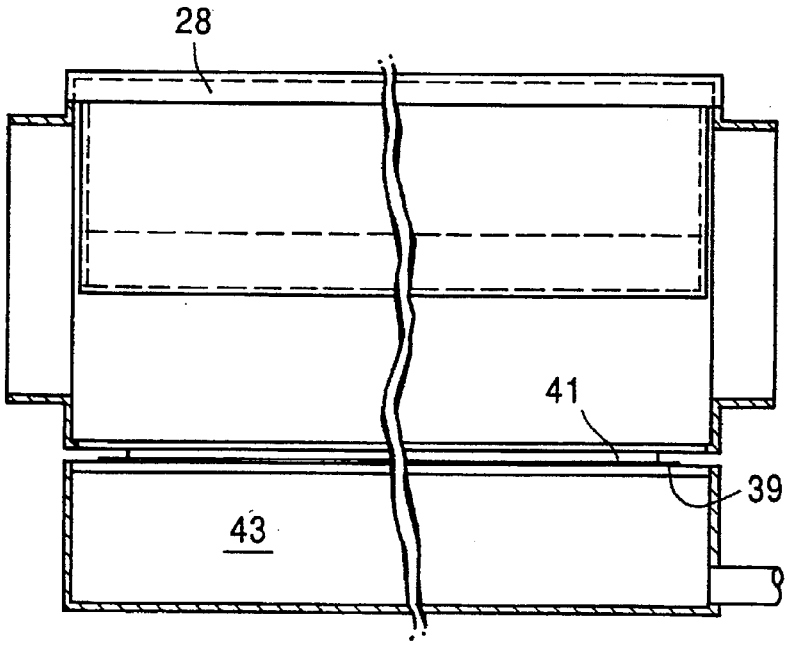
FIG. 7 is a cross-sectional view of the sheet-forming roll, taken along the line VII—VII in FIG. 6.

As shown in FIGS. 6 and 7, the bottom wire 39 is wound around the lower circumference of the sheet-forming roll 28 with the paper sheet 41 on the bottom wire 39 interposed therebetween, and is caused to turn at the second wire-turning roll 7 in a downward direction. In the preferred embodiment, the central angle for the circumference of the forming roll 28 on which the bottom wire 39 is wound is designed so as to range from about 170° to 10°. Furthermore, a first pair of peripheral boxes 43 and a second pair of peripheral boxes 44, each pair comprised of pressurizing and suction boxes of ±700 to 1500 mm water pressure, are mounted on the frame 33 in opposed relation to the circumferential part of the forming roll 28 around which the bottom wire 39 is wound. The range of the wire-wound zone on the forming roll 28 can be adjusted by operating the frame 33 to move the sheet-forming roll 28 in a vertical direction. In the foregoing, it is envisaged that several kinds of peripheral boxes of a narrow width may be employed so as to meet the change in the wound angle of the bottom wire 39 on the forming roll 28, or that in case of the minimum wound angle, only one pair of the peripheral boxes may be provided.

In the case where the on-top wire 40 is used, the on-top wire 40 is first introduced to be wound on the lower circumference of the sheet-forming roll 28 so that the paper sheet is sandwiched between the on-top wire 40 and the bottom wire 39. Furthermore, when it is required that another sheet is to be formed on the on-top wire 40, the on-top wire 40 is first wound on the lower circumference of the sheet-forming roll 28, and the sheet 42 as well as the sheet 41 are sandwiched between the on-top wire 40 and the bottom wire 39.

For the fourth stage of the sheet formation, a fourth tilting frame 16 is mounted on the rearward part of the horizontal frames 12 of the machine frame assembly so as to tilt up and down about a rearward end adjacent to the suction couch roll 9, and a drive device 23 comprised of servo motors is mounted on the machine frame assembly with screw axis connected to the fourth tilting frame 16 to permit tilting movement of the tilting frame 16. In the preferred embodiment, the tilting frame 16 is designed so as to be tilted downwards in a rearward direction at an inclination angle of 0°~-20°. Furthermore, a number of suction boxes 8 are mounted on the fourth tilting frame 16 so as to be held in contact with the lower side of the bottom wire 39 travelling at the fourth zone or stage between the second wire-turning roll 7 and the suction couch roll 9.

In the foregoing, the second wire-turning roll 7 may be mounted on the forward end of the fourth tilting frame 16, not on the third tilting frame 15. However, the wound angle of the wire at the sheet-forming roll 28 is smaller.

Furthermore, more than two on-top columnar frames 31 are mounted on the sole plates 38 or on the horizontal frames 12 for the bottom wire 39, and horizontal frames 32 are connected therebetween to provide a rigid unitary structure. Thus, the endless on-top wire 40 is suspended on the rigid frame structure, and an on-top wire roll 29, which can be vertically and horizontally movable in response to the change in the wire position by operating a lifting device (not shown), is mounted at the forward end of the lower part of the rigid frame structure. Furthermore, on-top wire stretch rolls 30 are mounted on the aforesaid frame structure at a position above the sheet forming roll 28. Moreover, an on-top breast roll 26 is mounted at the forward end of the aforesaid frame structure so as to be shiftable in horizontal and vertical directions, whereby the position of the stock, jetted in a thin layer form from the head box 25, can be adjusted in an optimum point.

Furthermore, arranged between the on-top wire roll 29 and the sheet forming roll 28 are variable pressure foils 24' which are disposed in opposed relation to the foils 24 at the bottom wire side and are mounted on a tilting frame (not shown), which is vertically movable by means of a tilting device (not shown either). In the foregoing, the aforesaid on-top wire roll 29 and the on-top variable pressure foils 24' may be mounted on the second tilting frame 14 of the bottom wire side in opposed relation to the table rolls 6 and the variable pressure foils 24, and may be moved up and down by the drive device 21 so as to correspond to various wire positions.

Furthermore, an on-top couch roll 27 is arranged at the forward end of the on-top horizontal frame 32 so as to correspond to the on-top breast roll 26, and a number of on-top formation boards and multi-foils 35 are releasably arranged on the frame so as to be held in contact with the lower side of the on-top wire 40.

Moreover, in the first and second stages of sheet formation as well as in the sheet reformation stage, white water save-alls 18 and suction legs 19 for recovering the white water dewatered by the fiber-water suspension are provided on the horizontal frames 12.

In the sheet forming zone on the on-top wire 40, an on-top white water save-all 37 for recovering the white water dewatered by the fiber suspension is also provided on the on-top horizontal frame 32.

In the embodiment illustrated in FIG. 1, the wire arrangement is such that the upper surfaces of the bottom wire 39 extending from the breast roll 2 through the first and second wire-turning rolls 5 and 7 to the suction couch roll 9, are maintained generally horizontal, and that the bottom wire 39 is held in contact with the on-top wire 40 at a position between the on-top wire roll 29 and the plural table rolls 6. In this connection, it is envisaged that the contacting point of the on-top wire 40 with the bottom wire 39 can be adjusted by moving the on-top wire roll 29 up and down by means of a lifting device (not shown) to thereby move the contacting faces of both wires.

In the foregoing, as schematically shown, a control unit C is operably connected to the first, second, third and fourth tilting devices 20, 21, 22 and 23, and the sheet-forming roll drive device 34 to control the activation of the devices and so on to thereby adjust the inclination of the wire and the circumferential length of the wound portion.

Furthermore, it is also possible that the on-top wire 40 is stopped separately from the bottom wire 39 by moving upwards the sheet-forming roll 28, the on-top wire roll 29 and the on-top side foils 24' by means of respective drive devices.

The sheet forming method of the invention is suitably carried out using the above-described apparatus.

More specifically, referring to FIG. 1, the fiber-water suspension is supplied from the head box 1 onto the bottom wire 39 and spread thereon over the entire width of the wire, and the space between the pair of right and left nodeckles 17 is filled with the fiber-water suspension. Thus, the dewatering is carried out by the formation boards and multi-foils 4 to form a paper sheet 41 on the bottom wire 39 (first stage of sheet formation).

Then, the on-top wire 40 is brought into contact with the sheet 41 on the bottom wire 39, and the dewatering is further carried out between the bottom wire side foils 24 and the on-top wire foils 24' (second stage of sheet formation). In this stage, by regulating the dewatering amount in upward and downward directions, the psychical properties of paper such as the difference of top and bottom surfaces in surface strength, smoothness or the like can be optimally controlled to adjust the sheet formation in the vertical direction.

When supplying the fiber-water suspension onto the on-top wire 40 from the on-top head box 25, the stock is spread on the wire 40 over the entire width thereof, and the space between the pair of right and left nodeckles 36 is filled with the fiber-water suspension. Thus, the dewatering is carried out by the formation boards and multi-foils 35 to form a paper sheet 42 on the on-top wire 40, and as the sheet 42 formed on the on-top wire 40 contacts the sheet 41 formed on the bottom wire 39, the dewatering is further carried out by the bottom wire side foils 24 and the on-top foils 24' to form a unitary sheet. If different kinds of stock are supplied from the on-top and bottom sides, it is, for example, possible to produce a paper having colors different at top and bottom surfaces or a wall paper having an excellent peeling property.

Figure 2:
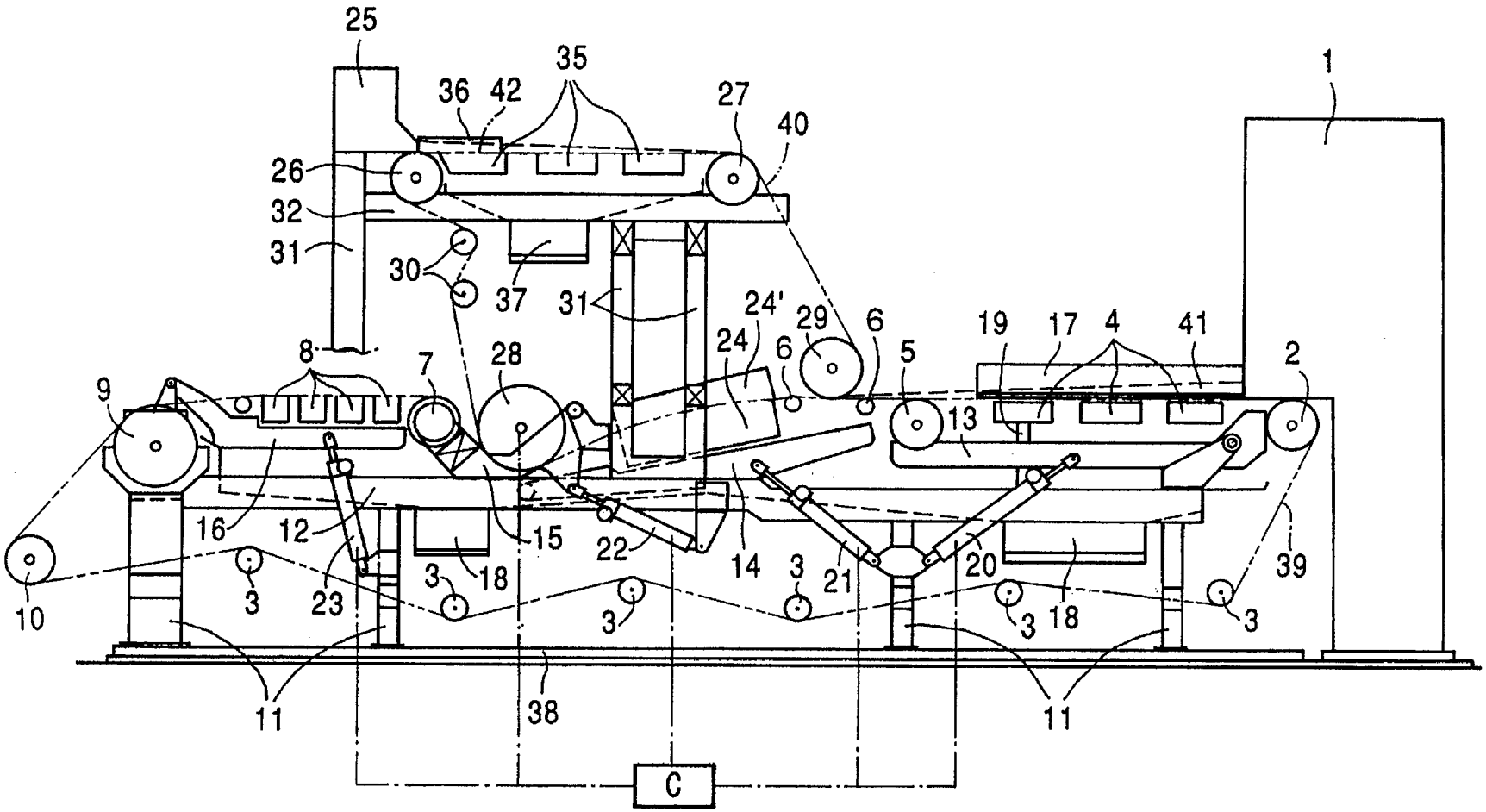
FIG. 2 is a view similar to FIG. 1, but showing an arrangement in which a sheet forming roll is lowered into a low position.
Figure 3:
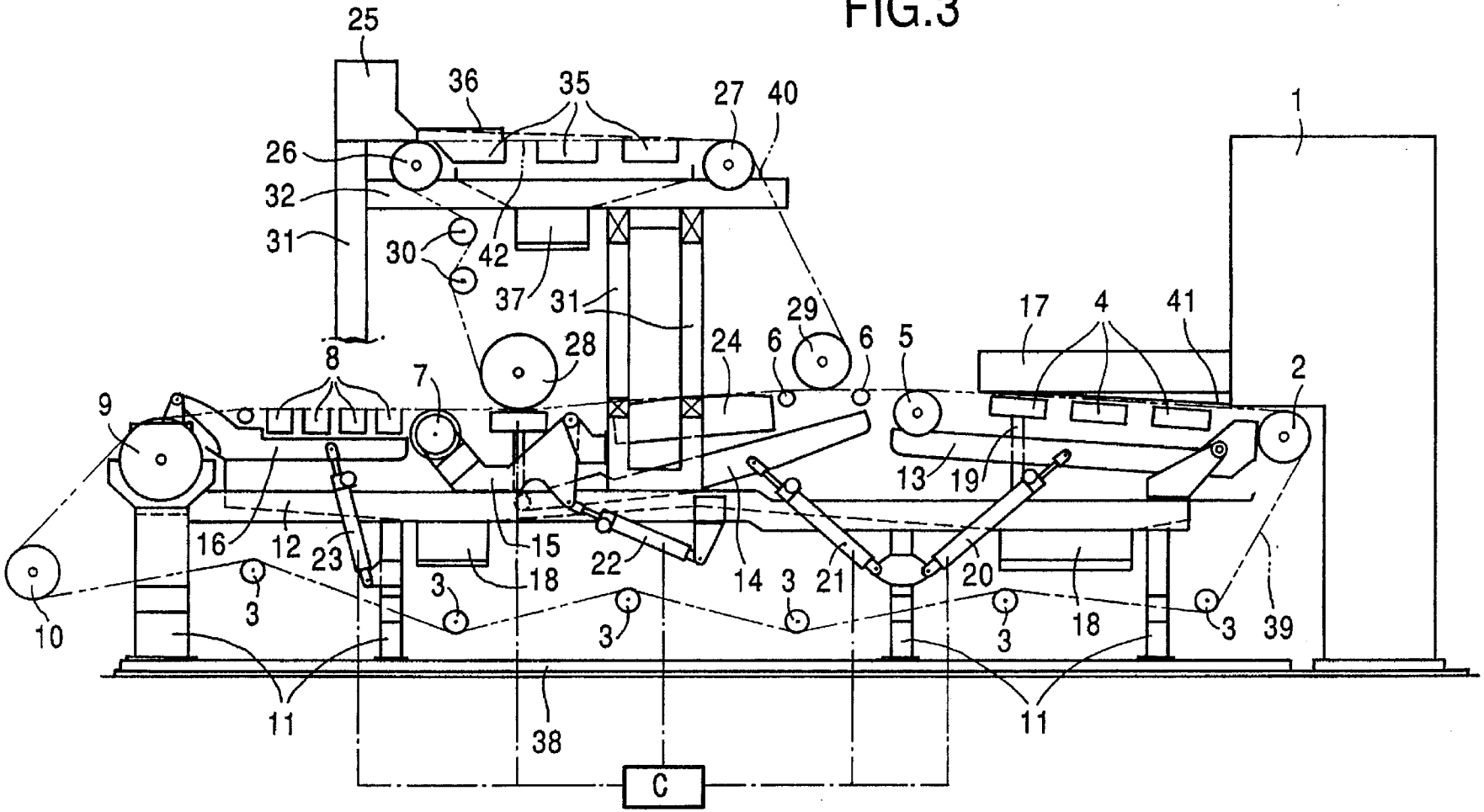
FIG. 3 is a view similar to FIG. 1, but showing an arrangement in which the zones of the bottom wire corresponding to the first and second stages of sheet formation are inclined upwards and downwards.
Figure 4:
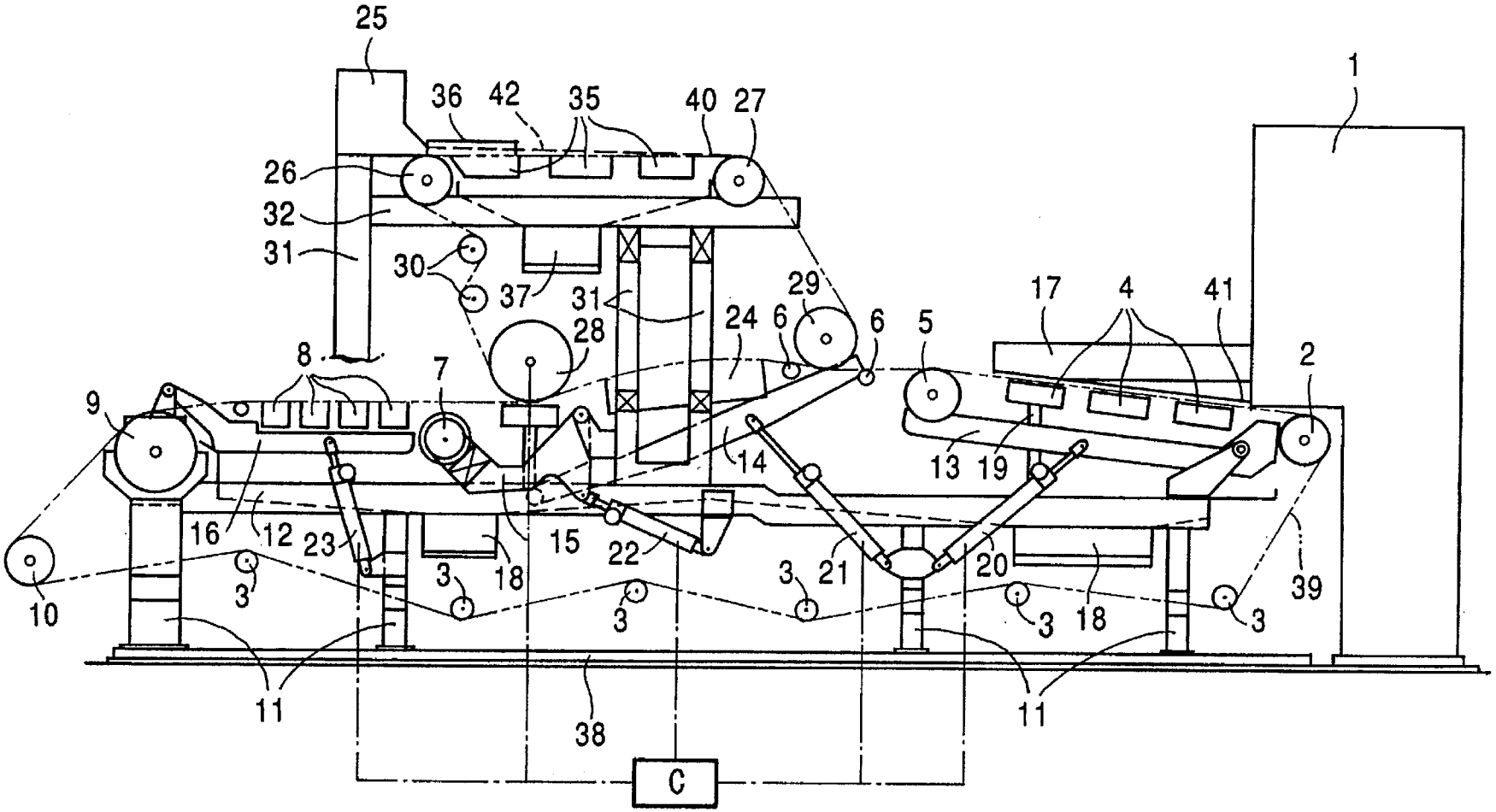
FIG. 4 is a view similar to FIG. 1, but showing an arrangement in which the zone of the bottom wire corresponding to the first stage of sheet formation is inclined upwards whereas the wire zone corresponding to the second stage of sheet formation is inclined so as to define a raised intermediate portion.

Although in the apparatus shown in FIG. 1, the bottom wire 39 is suspended so as to keep the surface horizontal, the wire-arrangements can be modified according to the paper-making conditions. More specifically, in the embodiment shown in FIG. 2, the sheet-forming roll 28 is moved into a lower position under the horizontal plane defined by the positions of the bottom wire 39 at the first and second stages of sheet formation. With this movement of the forming roll 28, the angle of the wire wound zone on the forming roll is increased. Furthermore, in the embodiment shown in FIG. 3, the bottom wire arrangements at the first and second stages of the sheet formation are modified such that the bottom wire 39 at the first stage is inclined upwards in a rearward direction whereas that at the second stage is inclined downwards in a rearward direction. Also, in FIG. 4, the bottom wire 39 at the first stage is arranged so as to be inclined upwards in a rearward direction, and the bottom wire at the second stage is arranged such that its intermediate portion is somewhat raised. Furthermore, in FIG. 5, the bottom wire 39 at the first stage is inclined upwards in a rearward direction, whereas the wire at the second and fourth stages is inclined downwards in a rearward direction.

Figure 5:
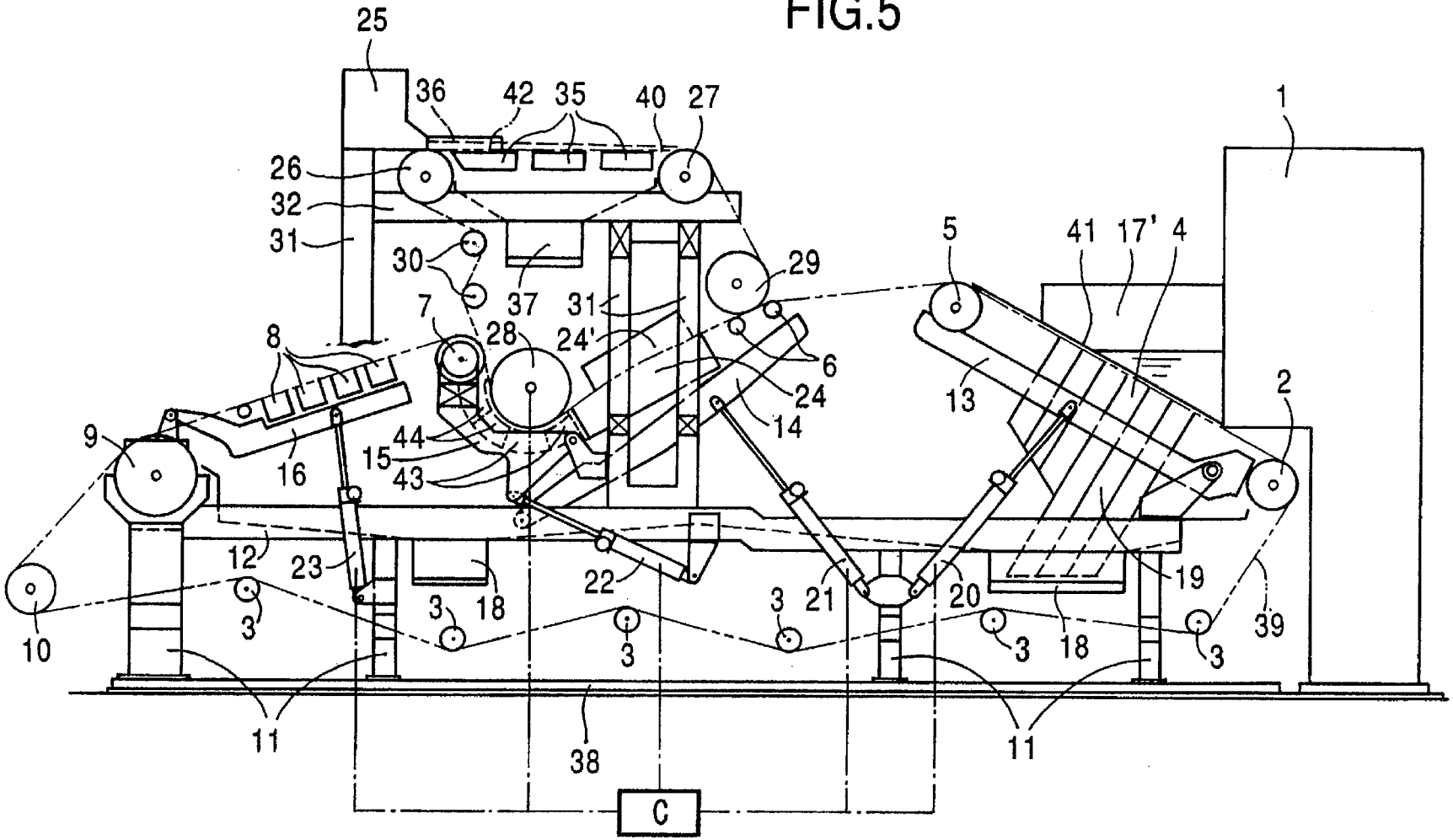
FIG. 5 is a view similar to FIG. 1, but showing an arrangement in which the zones of the bottom wire corresponding to the first and second stages of sheet formation are inclined upwards and downwards, respectively, and the wire zone corresponding to the fourth stage of sheet formation is further inclined downwards.

In particular, in the wire-arrangements shown in FIG. 5, the fiber-water suspension is supplied from the head box 1 onto the upwardly inclined bottom wire 39 and spread thereon over its entire width, and the space between the pair of right and left nodeckles 17' is filled with the fiber-water suspension. Thus, the dewatering is carried out by the formation boards and multi-foils 4 to form a paper sheet 41 on the bottom wire 39. Then, the on-top wire 40, which reaches the highest position, is brought into contact with the sheet 41 on the bottom wire 39 at a position between the table rolls 6 and the on-top wire rolls 29 or at a position after passing these rolls, and the dewatering is further carried out between the bottom wire side foils 24 and the on-top wire foils 24'. Subsequently, movement of water in vertical and horizontal directions is produced at a zone from the first pair of peripheral boxes 43 to the second pair of peripheral boxes 44. In this connection, when the surface of the sheet-forming roll 28 uses a plain wire, it is possible, by regulating the direction of movement of water as well as water amount, to obtain smoked glass type paper formation of the highest quality, which can not be obtained by wood pulp of a long fiber such as NBKP. Additionally, when the materials obtained by photoengraving various patterns or prints on metal or plastic material are attached to the surface of the sheet-forming roll 28, watermark paper of the highest quality can be produced.

As described above, it is possible, by suitably adjusting the upward and downward inclination angles of wire arrangement at the first and second stages, to ensure sufficient dispersion of fiber on the wire, an optimal initial formation of sheet, and adjustment of the difference between front and rear surfaces of the sheet. Furthermore, it is possible, by causing the bottom wire to be sufficiently wound around the sheet-forming roll, to form water flow in vertical and horizontal directions in the sheet sandwiched between the top and bottom wires to enable the reformation of the sheet or the formation of various watermarks. Furthermore, it is possible, by adjusting the downward inclination angle of the bottom wire at the fourth stage of sheet formation, to carry out the final adjustment of water content in the wet web.

What is claimed is:

1. An apparatus for forming a sheet from a fiber-water suspension, the apparatus comprising:

an endless bottom wire constructed to travel while receiving the fiber-water suspension thereon, said bottom wire defining first to fourth zones corresponding to first to fourth sheet-forming stages;

a head box for supplying the fiber-water suspension onto said endless bottom wire, said first to fourth zones being located downstream of said head box;

a first tilting device pivotally mounted on a machine frame and associated with said first zone of said bottom wire for adjusting an inclination of the bottom wire at the first zone thereof;

a second tilting device pivotally mounted on said machine frame and associated with said second zone of said bottom wire for adjusting an inclination of the bottom wire at the second zone thereof;

a sheet-forming roll mounted on a pivotable frame which is pivotally mounted on said machine frame, said sheet forming roll being associated with said third zone of said bottom wire for carrying out reformation of the sheet, said sheet-forming roll having a wound portion around which said bottom wire is wound to carry the sheet therebetween;

a drive device operatively connected to said pivotable frame for shifting said sheet-forming roll;

a third tilting device pivotally mounted on said machine frame and associated with said sheet-forming roll for cooperating with said drive device to shift said sheet-forming roll relative to the bottom wire in a vertical plane to control a circumferential length of the wound portion;

a fourth tilting device pivotally mounted on said machine frame and associated with said fourth zone of said bottom wire for adjusting an inclination of the bottom wire at the fourth zone thereof;

a plurality of dewatering devices associated with each of said tilting devices and with a respective zone of said bottom wire; and a control unit operably connected to said first, second, third and fourth tilting devices and said drive device for adjusting the inclination of said bottom wire and the circumferential length of the wound portion.

2. A sheet-forming apparatus according to claim 1, further comprising a wire turning roll mounted on said third tilting device and disposed adjacent to said sheet-forming roll for guiding the bottom wire so as to travel around the sheet-forming roll, said dewatering device associated with said fourth zone of said bottom wire including at least one dewatering box arranged in opposed relation to said fourth zone of said bottom wire.

3. A sheet-forming apparatus according to claim 1, wherein each of said tilting devices includes a movable frame for supporting said bottom wire and a drive mechanism operably connected to said movable frame for tilting the movable frame.

4. A sheet-forming apparatus according to claim 1, further comprising an endless top wire constructed to travel along said bottom wire at the second and third zones corresponding to the second and third sheet-forming stages.

* * * * *